US007195332B2

(12) United States Patent
Akase et al.

(10) Patent No.: US 7,195,332 B2
(45) Date of Patent: Mar. 27, 2007

(54) LIQUID EJECTING APPARATUS

(75) Inventors: Takashi Akase, Nagano-ken (JP); Nobuhito Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 328 days.

(21) Appl. No.: 10/954,371

(22) Filed: Oct. 1, 2004

(65) Prior Publication Data

US 2005/0146585 A1 Jul. 7, 2005

(30) Foreign Application Priority Data

Oct. 1, 2003 (JP) ..... 2003-343841
Sep. 10, 2004 (JP) ..... 2004-264670

(51) Int. Cl.
*B41J 2/165* (2006.01)

(52) U.S. Cl. ..... 347/23; 347/36

(58) Field of Classification Search ..... 347/5, 347/7, 19, 23, 30, 36, 37, 87
See application file for complete search history.

(56) References Cited

U.S. PATENT DOCUMENTS 5,172,140 A * 12/1992 Hirabayashi et al. ..... 347/36
5,245,362 A * 9/1993 Iwata et al. ..... 347/23
6,357,854 B1 * 3/2002 Igval et al. ..... 347/36
6,676,236 B1 * 1/2004 Uchikata ..... 347/5

FOREIGN PATENT DOCUMENTS

JP 9-104121 A 4/1997
JP 11-300989 A 11/1999

* cited by examiner

*Primary Examiner*—Anh T. N. Vo
(74) *Attorney, Agent, or Firm*—Sughrue Mion, PLLC

(57) ABSTRACT

The present invention provides an ink-jet type recording apparatus that accurately compute the remaining amount of waste liquid, thereby utilizing a waste-liquid absorbing function of the waste liquid absorber at a maximum and prevent the waste liquid from leaking outside the apparatus. The ink-jet type recording apparatus includes a first remaining amount counter for managing a remaining amount A of waste liquid of which an evaporation amount is computed based on time information acquired from a host, a second remaining amount counter for managing a remaining amount B of waste liquid of which an evaporation amount is computed in case where there is not time information from the host, and an overflow deciding unit for accurately deciding the remaining amount of waste liquid by adding A and B when computing the total amount of waste liquid in a waste liquid absorber.

14 Claims, 8 Drawing Sheets

LIQUID EJECTING APPARATUS

This patent application claims priority from Japanese Patent Applications Nos. 2003-343841 filed on Oct. 1, 2003 and 2004-264670 filed on Sep. 10, 2004, the contents of which are incorporated herein by reference.

BACKGROUND OF THE INVENTION

1. Field of the Invention

The present invention relates to a liquid ejecting apparatus for ejecting liquid to a target. More particularly, the present invention relates to a liquid ejecting apparatus for managing a remaining amount of waste liquid, which is accommodated in an accommodating section, discharged from a liquid ejecting head in order to recover liquid-ejection ability of the liquid ejecting head.

2. Description of Related Art

In a liquid ejecting apparatus such as an ink-jet type recording apparatus for ejecting liquid to a target, a cleaning operation during which liquid is discharged or absorbed from a liquid ejecting head is performed separately from ejecting liquid to the target in order to prevent a clogging of the head or to recover liquid-ejection ability of the head. The liquid discharged from the head during the cleaning operation is accommodated in a waste liquid absorber.

A remaining amount of waste liquid in the waste liquid absorber is computed whenever a recovery operation is performed. In this way, when the computed remaining amount exceeds a certain threshold value, the apparatus is controlled to display an error message that requires maintenance or to prohibit the recovery operation. In this case, some of the waste liquid is evaporated as time has elapsed after the waste liquid has been discharged. Therefore, it is possible to accurately compute the remaining amount of waste liquid in the waste liquid absorber by computing an evaporation amount of the waste liquid depending on an elapsed time.

By the way, to measure an elapsed time for computation of evaporation amount of waste liquid, there is a method by which a current time is acquired from a built-in clock every recovery operation and then an elapsed time is measured by difference between the current time and the previous acquired time. However, an accurate time cannot be acquired when electric power is not supplied to the built-in clock. Thus, the apparatus is controlled so as not to compute the evaporation amount of waste liquid when the built-in clock has stopped, the built-in clock had stopped before, or setting of the built-in clock has been changed. In this way, it is prevented that the evaporation amount is inaccurately computed, thereby being capable of managing the remaining amount of waste liquid suitably. This technique is known from, e.g., Japanese Patent Laid-Open No. 1997-104121.

However, in the conventional art, since an evaporation amount of waste liquid cannot be computed when a power source has been turned off for a long time, a remaining amount is computed higher than a real amount. Therefore, there was a problem that a waste liquid absorber cannot be utilized maximally when trying to prevent waste liquid from leaking outside the apparatus.

SUMMARY OF THE INVENTION

Therefore, it is an object of the present invention to provide a liquid ejecting apparatus which can solve the foregoing problems. The above and other objects can be achieved by combinations described in the independent claims. The dependent claims define further advantageous and exemplary combinations of the present invention.

According to the first aspect of the present invention, there is provided a liquid ejecting apparatus for ejecting liquid to a target. The liquid ejecting apparatus includes: a liquid ejecting head operable to eject liquid; a recovery section operable to recover liquid-ejection ability of the liquid ejecting head by performing a recovery operation during which the liquid ejecting head discharges the liquid to a position different from the target; an accommodating section operable to accommodate waste liquid discharged from the liquid ejecting head during the recovery operation; a discharge controlling unit operable to control an amount of waste liquid discharged from the liquid ejecting head during the recovery operation; a time acquiring unit operable to acquire and memorize time from an external information processor; a first remaining amount counter operable to memorize a first remaining amount of waste liquid in association with the recovery-operation time acquired from the time acquiring unit; and a first remaining amount computing unit operable to compute a first evaporation amount of the waste liquid that has been evaporated after a recovery operation performed at least one time ago based on difference between current recovery-operation time and time of the recovery operation performed at least one time ago, to compute the first remaining amount of the waste liquid after the current recovery operation by subtracting the first evaporation amount from the first remaining amount of the waste liquid memorized in the first remaining amount counter and adding an amount of waste liquid, which is discharged to the accommodating section during the current recovery operation, to the subtracted result, and to write the computed first remaining amount into the first remaining amount counter in association with the current recovery-operation time, when the time acquiring unit acquires the current recovery-operation time from the information processor. In this way, it is possible to accurately compute the remaining amount of waste liquid based on the time acquired from outside.

The liquid ejecting apparatus may further include: a timer operable to measure time passage in a state where a power source of the liquid ejecting apparatus is turned on; a second remaining amount counter operable to memorize a second remaining amount of waste liquid when the time acquiring unit does not acquire time from the information processor; and a second remaining amount computing unit operable to compute a second evaporation amount of waste liquid that has been evaporated after recovery operation performed at least one time ago based on the time passage measured by the timer, to compute the second remaining amount of the waste liquid after the current recovery operation by subtracting the second evaporation amount from the second remaining amount of the waste liquid memorized in the second remaining amount counter and adding an amount of waste liquid, which is discharged to the accommodating section during the current recovery operation, to the subtracted result, and to write the computed second remaining amount into the second remaining amount counter, when the time acquiring unit does not acquire time from the information processor. In this way, the remaining amount of waste liquid that is computed using the evaporation amount computed based on time information acquired from the external information processor and the remaining amount of waste liquid that is computed using the evaporation amount in a state where there is not time information acquired from the external information processor are managed distinctively. Thus, it is possible to accurately compute the remaining amount of waste liquid independently.

The liquid ejecting apparatus may include a total remaining amount computing unit operable to compute the sum of the first remaining amount and the second remaining amount and an overflow deciding unit operable to output an error message when the sum of the first remaining amount and the second remaining amount computed by the total remaining amount computing unit exceeds a threshold value of waste liquid that can be accommodated by the accommodating section. In this way, it is possible to accurately compute the remaining amount of waste liquid and to prevent the waste liquid from leaking by adding the first remaining amount and the second remaining amount when computing the total remaining amount of waste liquid in the accommodating section.

In the liquid ejecting apparatus, the overflow deciding unit may further cause the recovery section not to perform a recovery operation when the sum of the first remaining amount and the second remaining amount exceeds the threshold value of waste liquid that can be accommodated by the accommodating section. In this way, the increase of the waste liquid stops at the right time, thereby preventing the waste liquid from leaking outside the apparatus.

The liquid ejecting apparatus may further include: a first total discharge-amount counter operable to memorize a first total amount of waste liquid discharged during the recovery operation when the current time is acquired; a first remaining amount diagnosing unit operable to compute a first minimal remaining amount of the waste liquid that is accommodated in the accommodating section by multiplying the first total amount of waste liquid memorized in the first total discharge-amount counter by an evaporation residual ratio that is a ratio of liquid left by maximal evaporation of the liquid, and to replace the remaining amount of waste liquid computed by the first remaining amount computing unit with the first minimal remaining amount to write the replaced result into the first remaining amount counter when the remaining amount of waste liquid computed by the first remaining amount computing unit is lower than the first minimal remaining amount; a second total discharge-amount counter operable to memorize a second total amount of waste liquid discharged during the recovery operation when the current time is not acquired; and a second remaining amount diagnosing unit operable to compute a second minimal remaining amount of the waste liquid that is accommodated in the accommodating section by multiplying the second total amount of waste liquid memorized in the second total discharge-amount counter by the evaporation residual ratio, and to replace the remaining amount of waste liquid computed by the second remaining amount computing unit with the second minimal remaining amount to write the replaced result into the second remaining amount counter when the remaining amount of waste liquid computed by the second remaining amount computing unit is lower than the second minimal remaining amount. In this way, it is possible to prevent the remaining amount of waste liquid from being computed lower than it really is, thereby surely preventing the waste liquid from leaking outside the apparatus.

In the liquid ejecting apparatus, the first remaining amount computing unit may treat the first evaporation amount of the waste liquid as zero when the time acquired by the time acquiring unit is earlier than the previously acquired time, In this way, it is possible to prevent the evaporation amount from being computed inaccurately when the user changes the time of the external information processor.

In the liquid ejecting apparatus, the first remaining amount computing unit may treat the evaporation amount of the waste liquid as zero when difference between the time acquired by the time acquiring unit and the current acquired time exceeds a predetermined reference value. In this way, the first remaining amount computing unit can compute the evaporation amount of the waste liquid using only reliable evaporation time.

In the liquid ejecting apparatus, the first remaining amount computing unit and the second remaining amount computing unit may treat the evaporation amount of the waste liquid as zero when the sum of the first remaining amount and the second remaining amount exceeds a limit-access reference value lower than a threshold value of waste liquid that can be accommodated by the accommodating section. In this way, it is possible to prevent the remaining amount of waste liquid from being computed lower than it really is when the sum of the remaining amount of waste liquid approaches the threshold value of waste liquid that can be accommodated by the accommodating section.

In the liquid ejecting apparatus, the discharge controlling unit may reduce the amount of waste liquid discharged during the recovery operation when the sum of the first remaining amount and the second remaining amount exceeds a limit-access reference value lower than a threshold value of waste liquid that can be accommodated by the accommodating section. In this way, it is possible to reduce the increase speed of the remaining amount of waste liquid when the sum of the remaining amount of waste liquid approaches the threshold value of waste liquid that can be accommodated by the accommodating section.

The liquid ejecting apparatus may further include a timer operable to measure time passage in a state where a power source of the liquid ejecting apparatus is turned on, wherein the first remaining amount computing unit computes the first evaporation amount based on time interval from the previous recovery-operation time to the previously turned off time and time interval that measured by the timer after turning on the power source this time, and subtracts the first evaporation amount from the first remaining amount of the waste liquid memorized in the first remaining amount counter in order to compute the first remaining amount, when the time acquiring unit does not acquire time from the information processor in the current recovery operation. In this way, it is possible to approximately compute the evaporation amount until that time even when the time is unclear.

In the liquid ejecting apparatus, the first remaining amount computing unit may compute the first evaporation amount based on time interval from the previous recovery-operation time to the previously turned off time and time interval from the currently turned on time to the current recovery-operation time, and subtracts the first evaporation amount from the first remaining amount of the waste liquid memorized in the first remaining amount counter in order to compute the first remaining amount, when the time acquiring unit has not acquired time from the information processor in the previous recovery operation and the time acquiring unit acquires time from the information processor in the current recovery operation. In this way, it is possible to approximately compute the evaporation amount until that time even when the time is unclear.

In the liquid ejecting apparatus, the first remaining amount computing unit may compute the first remaining amount using a predetermined fixed value as a remaining amount to a discharge amount with regard to the discharge amount of a recovery operation before a predetermined number of times or a predetermined time. In this way, it is possible to easily compute the remaining amount.

The liquid ejecting apparatus may further include a timer operable to measure time passage in a state where a power source of the liquid ejecting apparatus is turned on, wherein the recovery section: adds difference between the previous recovery-operation time and the current time to elapsed time after the previous recovery operation when the time acquiring unit has acquired the previous recovery-operation time and also acquires the current time from the information processor; adds difference between the previous recovery-operation time acquired from the information processor and the previously turned off time and time interval from the currently turned on time to now, which is measured by the timer, to the elapsed time, when the time acquiring unit has acquired the previous recovery-operation time and does not acquire the current time; and performs the current recovery operation when the elapsed time after the previous recovery operation exceeds a predetermined period. In this way, it is possible to approximately acquire the elapsed time from the previous cleaning operation even when not acquiring the time from the outside, thereby automatically performing the cleaning operation at an appropriate time.

According to the second aspect of the present invention, there is provided a liquid ejecting apparatus for ejecting liquid to a target. The liquid ejecting apparatus includes: a liquid ejecting head operable to eject liquid; a recovery section operable to recover liquid-ejection ability of the liquid ejecting head by performing a recovery operation during which the liquid ejecting head discharges the liquid to a position different from the target; an accommodating section operable to accommodate waste liquid discharged from the liquid ejecting head during the recovery operation; a discharge controlling unit operable to control an amount of waste liquid discharged from the liquid ejecting head during the recovery operation; a remaining amount counter operable to memorize a remaining amount of waste liquid; a remaining amount computing unit operable to compute an evaporation amount of the waste liquid that has been evaporated from a recovery operation performed at least one time ago to a current recovery operation based on time passage between the current recovery operation and the recovery operation performed at least one time ago, to subtract the evaporation amount from the remaining amount of the waste liquid memorized in the remaining amount counter, and to add an amount of waste liquid, which is discharged to the accommodating section during the current recovery operation, to the subtracted result, in order to compute the remaining amount of the waste liquid after the current recovery operation and write the computed remaining amount into the remaining amount counter in association with the current recovery-operation time; a total discharge-amount counter operable to memorize a total amount of waste liquid discharged during the recovery operation; and a remaining amount diagnosing unit operable to compute a minimal remaining amount of the waste liquid that is accommodated in the accommodating section by multiplying the total amount of waste liquid memorized in the total discharge-amount counter by an evaporation residual ratio that is a ratio of liquid left by maximal evaporation of the liquid, and to replace the remaining amount of waste liquid computed by the remaining amount computing unit with the minimal remaining amount to write the replaced result into the remaining amount counter when the remaining amount of waste liquid computed by the remaining amount computing unit is lower than the minimal remaining amount in the current recovery operation. In this way, it is possible to prevent the remaining amount of waste liquid from being computed lower than it really is, thereby surely preventing the waste liquid from leaking outside the apparatus.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
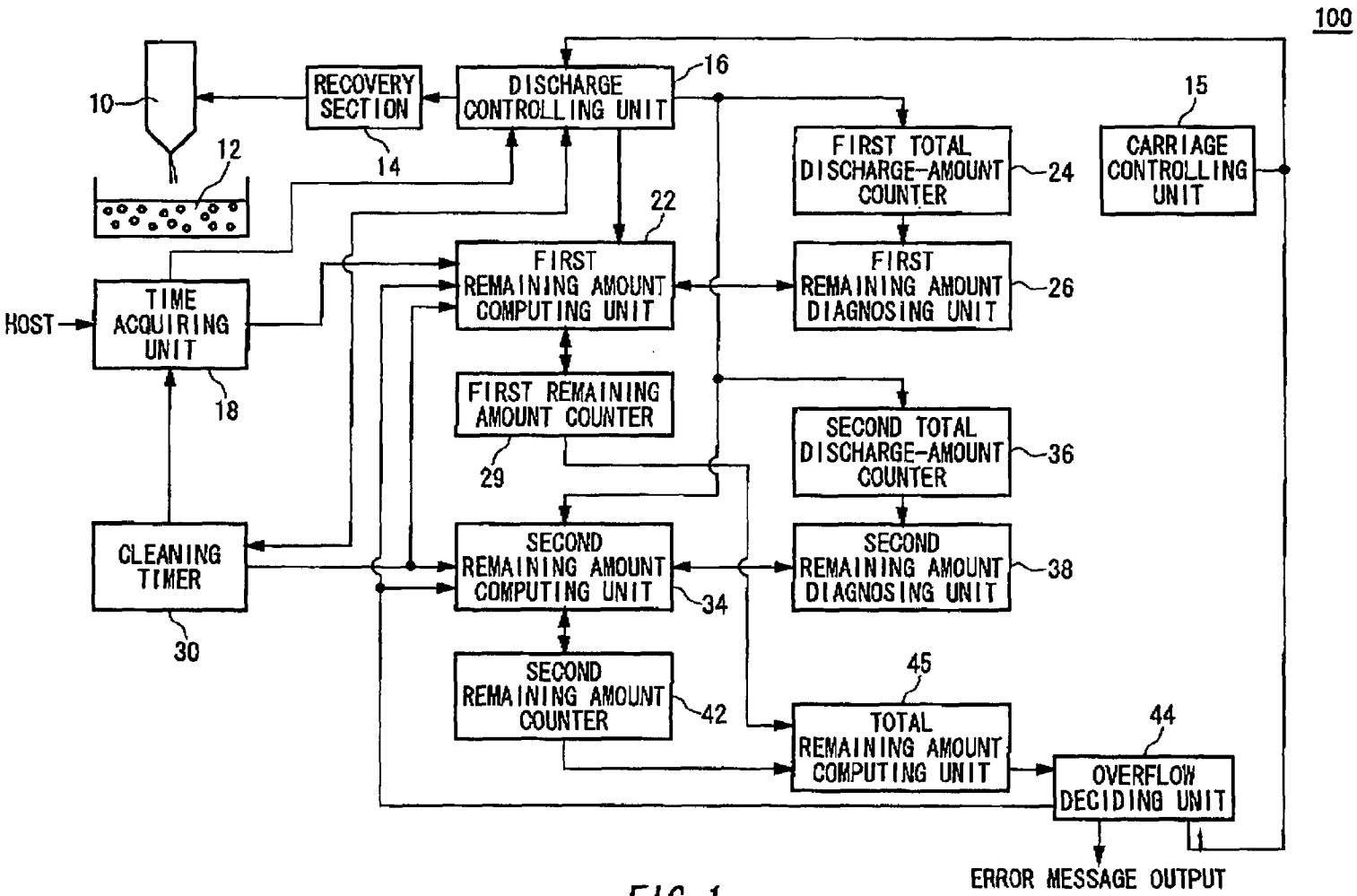
FIG. 1 is a block diagram showing a functional configuration of an ink-jet type recording apparatus 100.

FIG. 1 shows a functional configuration of an ink-jet type recording apparatus 100. The ink-jet type recording apparatus 100 performs recording by ejecting ink from a nozzle of a recording head 10 toward a recording material, which is an example of a target of the present invention. The ink-jet type recording apparatus 100 performs a cleaning operation at arbitrary times for recovering defective printing, at regular times for obviating clogging of a nozzle, at changing times for changing an ink cartridge, and soon. The ink-jet type recording apparatus 100 computes a remaining amount of waste liquid when performing a cleaning operation and turning off a power source of the ink-jet type recording apparatus 100.

Here, the ink-jet type recording apparatus 100 is an example of a liquid ejecting apparatus of the present invention. In addition, the recording head 10 of the ink-jet type recording apparatus 100 is an example of a liquid ejecting head of the liquid ejecting apparatus. The cleaning operation is an example of a recovery operation of the present invention.

However, the present invention is not limited to this. As another example of the liquid ejecting apparatus, there is a color filter manufacturing apparatus for manufacturing a color filter of a liquid crystal display. In this case, a color material ejecting head of the color filter manufacturing apparatus is an example of the liquid ejecting head. Yet another example of the liquid ejecting apparatus is an electrode forming apparatus for forming electrodes of a display such as an organic EL display, an FED (Field Emission Display) or the like. In this case, an electrode material (conduction paste) ejecting head of the electrode forming apparatus is an example of the liquid ejecting head.

Yet another example is a biochip manufacturing apparatus for manufacturing biochips. In this case, a bio organism ejecting head of the biochip manufacturing apparatus and a sample ejecting head as a minute pipette are examples of the liquid ejecting head. The liquid ejecting apparatus of the present invention includes other liquid ejecting apparatuses used for industrial purposes. In addition, the recording material is a material on which recording or printing is performed by ejection of liquid, which includes a recording paper, a circuit board on which circuit patterns such as display electrodes are formed, a CD-ROM for label printing, a preparation on which a DNA circuit is printed.

A functional configuration of the ink-jet type recording apparatus 100 will be explained below. The ink-jet type recording apparatus 100 includes a recovery section 14, a waste liquid absorber 12, a discharge controlling unit 16, and a carriage controlling unit 15. The recovery section 14 recovers or holds ink-ejection capability of the recording head by performing a cleaning operation during which the recording head discharges ink to a position different from the recording material. The waste liquid absorber 12 accommodates waste liquid discharged from the recording head 10 during the cleaning operation. The discharge controlling unit 16 controls an amount of waste liquid discharged from the recording head 10 during the cleaning operation. The carriage controlling unit 15 controls an operation of a carriage. The waste liquid absorber 12 is an example of an accommodating section of the present invention. The discharge controlling unit 16 controls an amount of ink, which is discharged or absorbed during the recovery section 14 from the recording head 10, according to a kind of cleaning. Generally, the recovery section 14 is controlled so that ink is discharged or absorbed as much as clogging is terrible.

Further, the ink-jet type recording apparatus 100 includes a time acquiring unit 18, a first remaining amount counter 29, and a first remaining amount computing unit 22. The time acquiring unit 18 acquires and memorizes time from an external information processor. The first remaining amount counter 29 memorizes a first remaining amount of waste liquid in association with the cleaning operation time acquired from the time acquiring unit 18. The first remaining amount computing unit 22 computes the remaining amount of the waste liquid after the cleaning operation when the time acquiring unit 18 acquires the current time based on difference between time of the current cleaning operation and time of cleaning operation performed at least one time ago. The first remaining amount counter 29 stores a remaining amount of waste liquid on a nonvolatile memory such as EEPROM.

The first remaining amount computing unit 22 computes a remaining amount of waste liquid as described below when acquiring time from an external information processor. The first remaining amount computing unit 22 computes a first evaporation amount of the waste liquid that has been evaporated after time of cleaning operation performed at least one time ago based on difference between time of a current cleaning operation and time of cleaning operation performed at least one time ago when the time acquiring unit 18 acquires the current cleaning operation time from the information processor. Further, the first remaining amount computing unit 22 computes the first remaining amount of the waste liquid after the current cleaning operation when the time acquiring unit 18 acquires the time by subtracting the first evaporation amount from the first remaining amount of the waste liquid (after the cleaning operation performed at least one time before) memorized in the first remaining amount counter and adding an amount of waste liquid, which is discharged to the accommodating section during the current cleaning operation, to the subtracted result. Moreover, the first remaining amount computing unit 22 writes the computed first remaining amount into the first remaining amount counter in association with the current cleaning operation time. In this way, it is possible to accurately compute the remaining amount of waste liquid based on the time acquired from outside. Additionally, in the present embodiment, a previous cleaning operation is explained as an example with regard to a cleaning operation performed at least one time ago. However, the present invention is not limited to this. Thus, the first remaining amount computing unit 22 may respectively compute a remaining amount of waste liquid with respect to a cleaning operation before a predetermined times such as last but one time or a predetermined time.

Here, the time acquiring unit 18 informs the discharge controlling unit 16 of whether the time acquiring unit 18 has acquired the current cleaning operation time from a host that is an example of an information processor when performing a cleaning operation after moving the ink-jet type recording apparatus 100, The discharge controlling unit 16 informs the first remaining amount computing unit 22 of an amount of waste liquid that is discharged to the waste liquid absorber 12 during the current cleaning operation when the time acquiring unit 18 has acquired time. The time acquiring unit 18 stores the time acquired from the host on a nonvolatile memory such as EEPROM. The time acquiring unit 18 outputs difference between the current cleaning operation time and the previous cleaning operation time that is stored as evaporation time of waste liquid after the previous computation of the remaining amount when acquiring the current cleaning operation time from the host. In addition, the time acquiring unit 18 may inform the first remaining amount computing unit 22 of difference between the time when a power source has been turned on and the time when the power source has been turned off when the power source of the ink-jet type recording apparatus 100 has been turned off. In this case, the first remaining amount computing unit 22 may also compute the first remaining amount by computing an evaporation amount that is evaporated from turning on to turning off and subtracting the evaporation amount from the previous first remaining amount memorized in the first remaining amount counter. In this case, since a cleaning operation is not performed, the first remaining amount computing unit 22 treats the discharge amount of waste liquid as zero during computation of the first remaining amount.

Since the time acquiring unit 18 acquires time from an external host and stores it on a nonvolatile memory whenever computing the remaining amount of waste liquid, although a power source of the ink-jet type recording apparatus 100 has been turned off for a long time, it is possible to output evaporation time of waste liquid after computing the remaining amount at the previous time. Therefore, the first remaining amount computing unit 22 can accurately compute the remaining amount of waste liquid until just before the current cleaning operation is performed based on the evaporation amount of waste liquid by the difference when the time acquiring unit 18 acquires time from the host.

The ink-jet type recording apparatus 100 further includes a cleaning timer 30, a second remaining amount counter 42, and a second remaining amount computing unit 34. The cleaning timer 30 measures time passage in a state where a power source of the ink-jet type recording apparatus 100 is turned on. The second remaining amount counter 42 memorizes a second remaining amount of waste liquid when the time acquiring unit 18 does not acquire time from the host. The second remaining amount computing unit 34 computes the second remaining amount of the waste liquid that has been evaporated after the previous cleaning operation based on the time passage measured by the cleaning timer 30 and writes the computed second remaining amount into the second remaining amount counter 42. The second remaining amount counter 42 stores the remaining amount of waste liquid on a nonvolatile memory such as EEPROM.

The second remaining amount computing unit 34 computes a remaining amount of waste liquid as described below when not acquiring time from the external host. The second remaining amount computing unit 34 computes a second evaporation amount of the waste liquid that has been evaporated after the previous cleaning operation time based on the time passage measured by the cleaning timer 30. The second remaining amount computing unit 34 further computes the second remaining amount of the waste liquid after the current cleaning operation when the time acquiring unit 18 does not acquire time from the host by subtracting the second evaporation amount from the second remaining amount of the waste liquid (after the previous cleaning operation) memorized in the second remaining amount counter 42 and adding an amount of waste liquid, which is discharged to the accommodating section 12 during the current cleaning operation, to the subtracted result. Furthermore, the second remaining amount computing unit 34 writes the computed second remaining amount into the second remaining amount counter 42 in association with time interval from the time of cleaning operation performed the predetermined times ago to the current cleaning operation time measured by the cleaning timer.

The ink-jet type recording apparatus 100 includes a total remaining amount computing unit 45 that computes the sum of the first remaining amount memorized in the first remaining amount counter 29 and the second remaining amount memorized in the second remaining amount counter, and an overflow deciding unit 44 that outputs an error message when the sum of the remaining amount of waste liquid computed by the total remaining amount computing unit 45 exceeds the threshold value of waste liquid that can be accommodated by the waste liquid absorber 12.

Here, the cleaning timer 30 outputs elapsed time according to timing at which a remaining amount of waste liquid is computed. For example, the cleaning timer 30 outputs either of time interval from turning on of the ink-jet type recording apparatus 100 to a cleaning operation, time interval from turning on to turning off, or time interval from a cleaning operation to turning off. The discharge controlling unit 16 informs the second remaining amount computing unit 34 of an amount of waste liquid that is discharged to the waste liquid absorber 12 during the current cleaning operation when the time acquiring unit 18 has not acquired time from the host during the current cleaning operation. In addition, the cleaning timer 30 may inform the second remaining amount computing unit 34 of time interval from turning on to turning off when the power source of the ink-jet type recording apparatus 100 has been turned off. In this case, the second remaining amount computing unit 34 may also compute the second remaining amount by computing an evaporation amount that is evaporated from turning on to turning off and subtracting the evaporation amount from the previous second remaining amount memorized in the second remaining amount counter 42. In this case, since a cleaning operation is not performed, the second remaining amount computing unit 34 treats the discharge amount of waste liquid as zero during computation of the second remaining amount.

According to the above configuration, the ink-jet type recording apparatus 100 distinctively manages the remaining amount of waste liquid that is computed using the evaporation amount computed based on time information acquired from the host and the remaining amount of waste liquid that is computed using the evaporation amount in a state where there is not time information acquired from the host, and adds both when computing the total remaining amount of waste liquid in the waste liquid absorber 12. Thus, it is possible to accurately compute the remaining amount of waste liquid.

The ink-jet type recording apparatus 100 further includes a first total discharge-amount counter 24 and a first remaining amount diagnosing unit 26. The first total discharge-amount counter 24 memorizes a first total amount of waste liquid discharged during the cleaning operation when the current time is acquired. The first remaining amount diagnosing unit 26 computes a first minimal remaining amount of the waste liquid that is accommodated in the waste liquid absorber 12 by multiplying the first total amount of waste liquid memorized in the first total discharge-amount counter 24 by an evaporation residual ratio that is a ratio of liquid left by maximal evaporation of the liquid, and replaces the remaining amount of waste liquid computed by the first remaining amount computing unit 22 with the first minimal remaining amount when the remaining amount of waste liquid computed by the first remaining amount computing unit 22 is lower than the first minimal remaining amount.

The first total discharge-amount counter 24 acquires an amount of the waste liquid that is discharged during the cleaning operation from the discharge controlling unit 16 in each case when the time acquiring unit 18 acquires time, adding the acquired amount to a total amount of the waste liquid acquired up to then and memorizing the result. In addition, the evaporation residual ratio depends on the type of ink, for example, being 0.4 to 0.5. When the first remaining amount computing unit 22 computes a remaining amount after evaporation of the waste liquid to correspond to lower ratio than the evaporation residual ratio of ink by the above function, the first remaining amount diagnosing unit 26 can suitably replace the remaining amount with a theoretical minimal remaining amount. Therefore, it is possible to prevent the remaining amount of waste liquid from being computed lower than it really is, thereby surely preventing the waste liquid from leaking outside the apparatus.

The ink-jet type recording apparatus 100 further includes a second total discharge-amount counter 36 and a second remaining amount diagnosing unit 38. The second total discharge-amount counter 36 memorizes a second total amount of waste liquid discharged during the cleaning operation when the time acquiring unit 18 has not acquired time. The second remaining amount diagnosing unit 38 computes a second minimal remaining amount of the waste liquid that is accommodated in the waste liquid absorber 12 by multiplying the second total amount of waste liquid memorized in the second total discharge-amount counter 36 by the evaporation residual ratio, and replaces the remaining amount of waste liquid computed by the second remaining amount computing unit 34 with the second minimal remaining amount when the remaining amount of waste liquid computed by the second remaining amount computing unit 34 is lower than the second minimal remaining amount.

The second total discharge-amount counter 36 acquires an amount of the waste liquid that is discharged during the cleaning operation from the discharge controlling unit 16 in each case when the time acquiring unit 18 has not acquired time, adding the acquired amount to a total amount of the waste liquid acquired up to then and memorizing the result. When the second remaining amount computing unit 34 computes a remaining amount after evaporation of the waste liquid to correspond to lower ratio than the evaporation residual ratio of ink by the above function, the second remaining amount diagnosing unit 38 can suitably replace the remaining amount with a theoretical minimal remaining amount. Therefore, it is possible to prevent the remaining amount of waste liquid from being computed lower than it really is, thereby surely preventing the waste liquid from leaking outside the apparatus.

Figure 2:
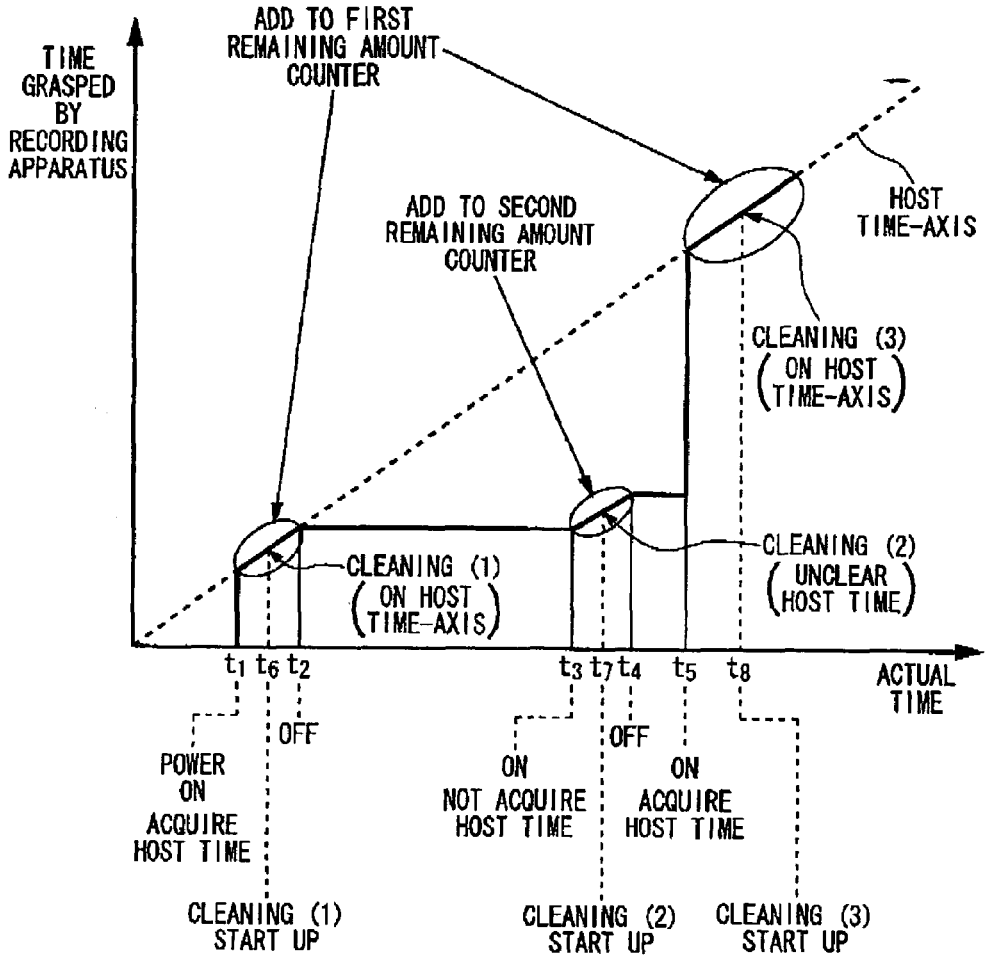
FIG. 2 is a chart explaining the reason to distinguish counters for adding waste liquid amount by presence or absence of an acquisition of current time.

FIG. 2 is a chart explaining the reason to distinguish counters for adding waste liquid by presence or absence of an acquisition of current time. In FIG. 2, a vertical axis shows a clock time recognized by the ink-jet type recording apparatus and a horizontal axis shows passage of an actual time. In addition, a thick line shows a change of the clock-time recognized by the ink-jet type recording apparatus 100 with respect to the actual time, and a dotted line shows a time base of the host.

As a premise, the ink-jet type recording apparatus 100 is turned on at the time of t1, t3, and t5, and is turned off at the time of t2 and t4. For example, time interval from the time t2 to t3 is 365 days, and time interval from the time t4 to t5 is 24 hours. Although the time acquiring unit 18 can acquire time interval (time) from the host at the time t1 and t5, it is assumed that the time acquiring unit 18 cannot acquire time interval from the host at the time t3 due to a number reasons. For example, the host cannot be connected to the ink-jet type recording apparatus 100. Therefore, the value of the time t3 is unknown. In this case, the cleaning timer 30 can however measure the passage of time from the time t3.

After turning on, the cleaning operations (1), (2), and (3) are performed at the time T6, T7, and T8 respectively. In this case, the ink-jet type recording apparatus 100 of the present embodiment adds an amount of waste liquid that is respectively discharged during the cleaning operations (1) and (3) to the value memorized in the first remaining amount counter 29 shown in FIG. 1, while adding an amount of waste liquid that is discharged during the cleaning operation (2) to the second remaining amount counter 42.

Here, when computing a remaining amount of waste liquid just before the cleaning operation (3), the ink-jet type recording apparatus 100 computes an evaporation amount of the waste liquid that has been discharged during the cleaning operation (1) using t8–t6 as the evaporation time, computing an evaporation amount of the waste liquid that has been discharged during the cleaning operation (2) using the time measured by the cleaning timer 30 as the evaporation time.

When an amount of the waste liquid that has been discharged during the cleaning operation (2) is memorized in the same counter as that memorizing an amount of the waste liquid that has been discharged during the cleaning operation (1), in case of computing a remaining amount of waste liquid just before the cleaning operation (3), an evaporation amount is computed using t8–t6 as evaporation time in order to compute a remaining amount of waste liquid that has been discharged during the cleaning operation (2). For example, an evaporation amount is computed using about one year as evaporation time with respect to the waste liquid that has been discharged during the cleaning operation before 24 hours. As a result, an evaporation amount is computed higher than a real amount, thereby a total remaining amount of waste liquid might be computed lower than a real amount. When repeating such a computation, the waste liquid is discharged beyond accommodation limit, thereby the waste liquid might leak outside the apparatus. Therefore, in the example shown in FIG. 2, when the time is not acquired from the host with regard to the current cleaning operation (2), the evaporation time of waste liquid by the previous cleaning operation (1) uses the passage of time (t7–t3) measured by the cleaning timer 30.

That is, the ink-jet type recording apparatus 100 of the present embodiment distinctively manages the remaining amount of waste liquid that is computed using the evaporation amount computed based on time information acquired from the host and the remaining amount of waste liquid that is computed using the evaporation amount in a state where there is not time information acquired from the host, thereby accurately computing the total remaining amount of waste liquid as needed. Thus, it is possible to prevent the waste liquid from leaking outside the apparatus.

Figure 3:
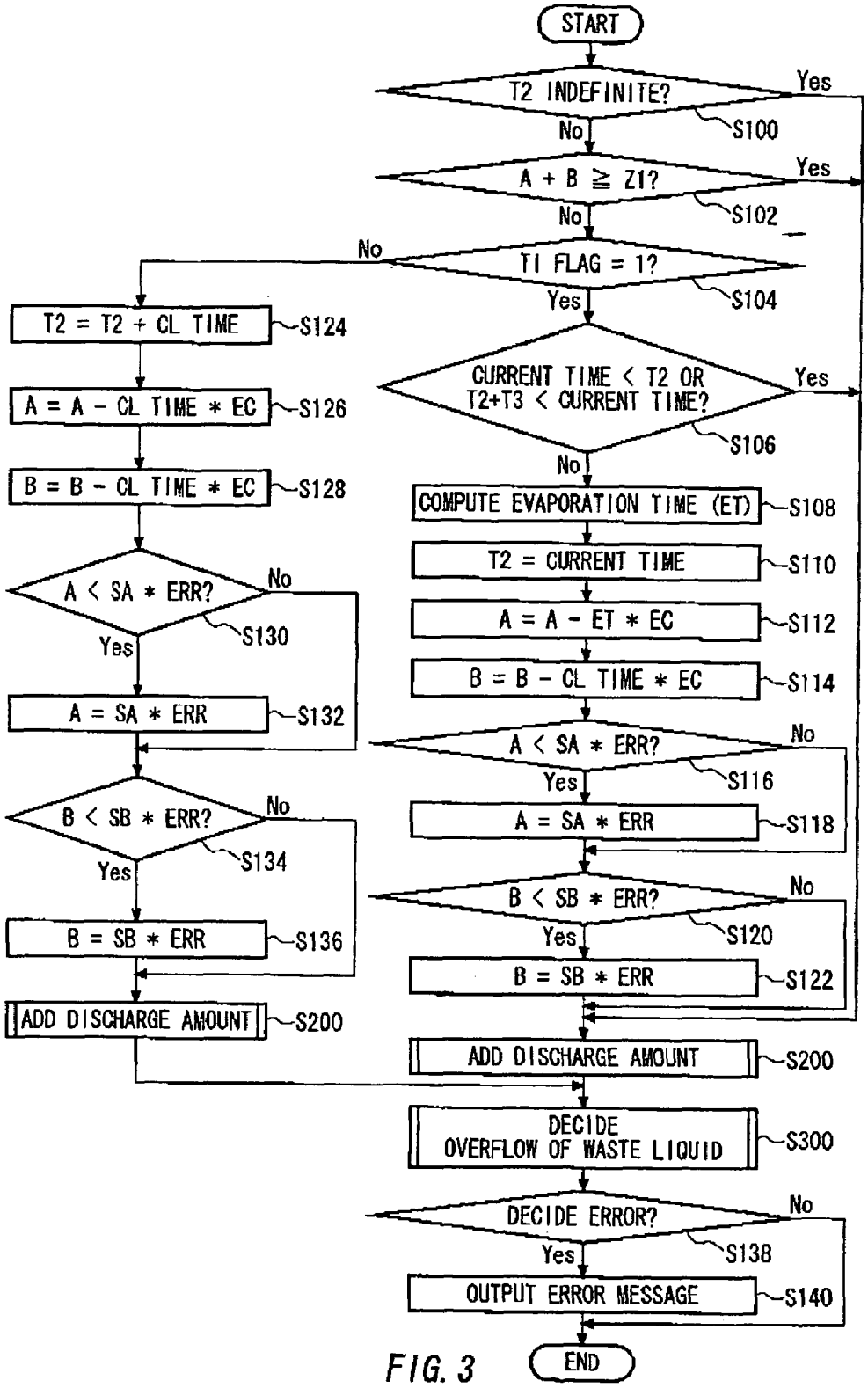
FIG. 3 is a flowchart showing steps by which the ink-jet type recording apparatus 100 computes a remaining amount of waste liquid.
Figure 4:
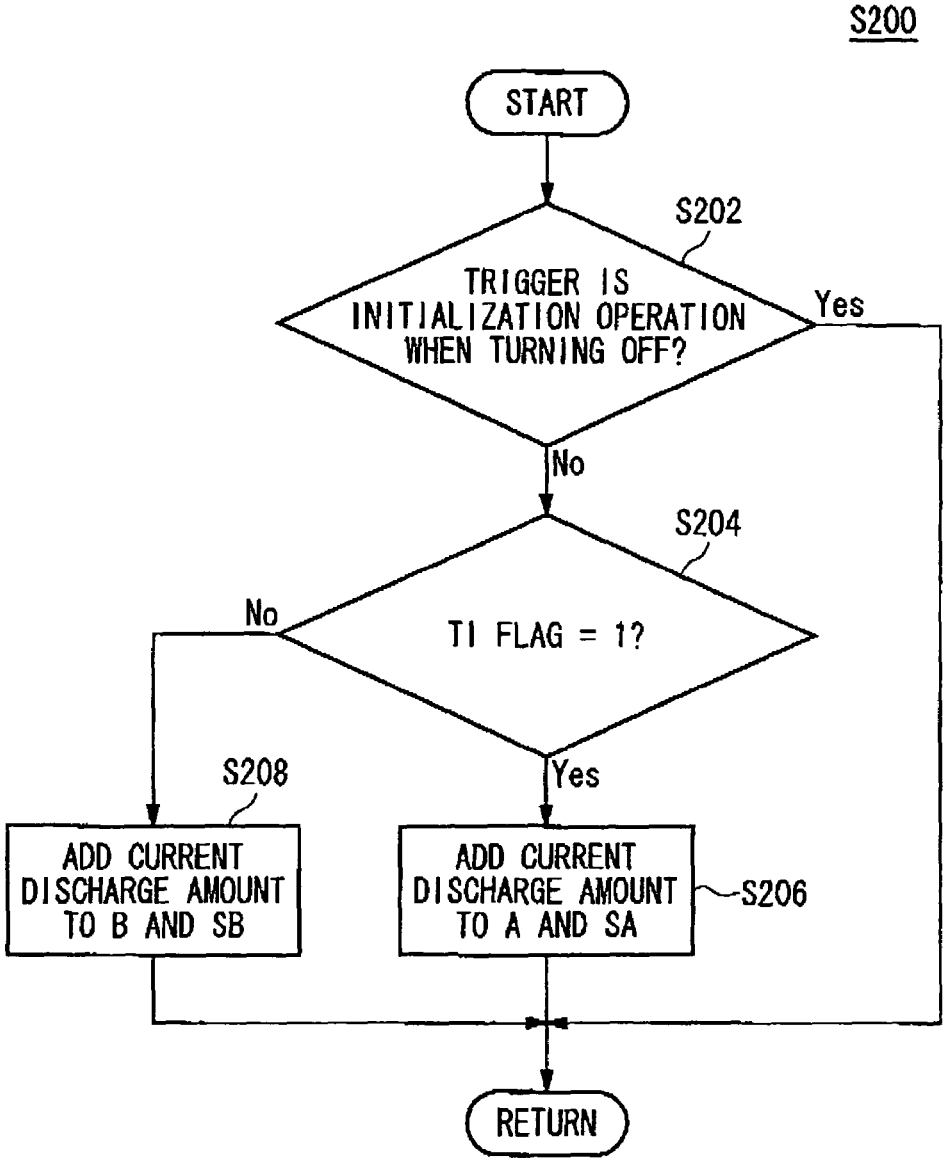
FIG. 4 is a flowchart showing further details about the step 200 in FIG. 3.
Figure 5:
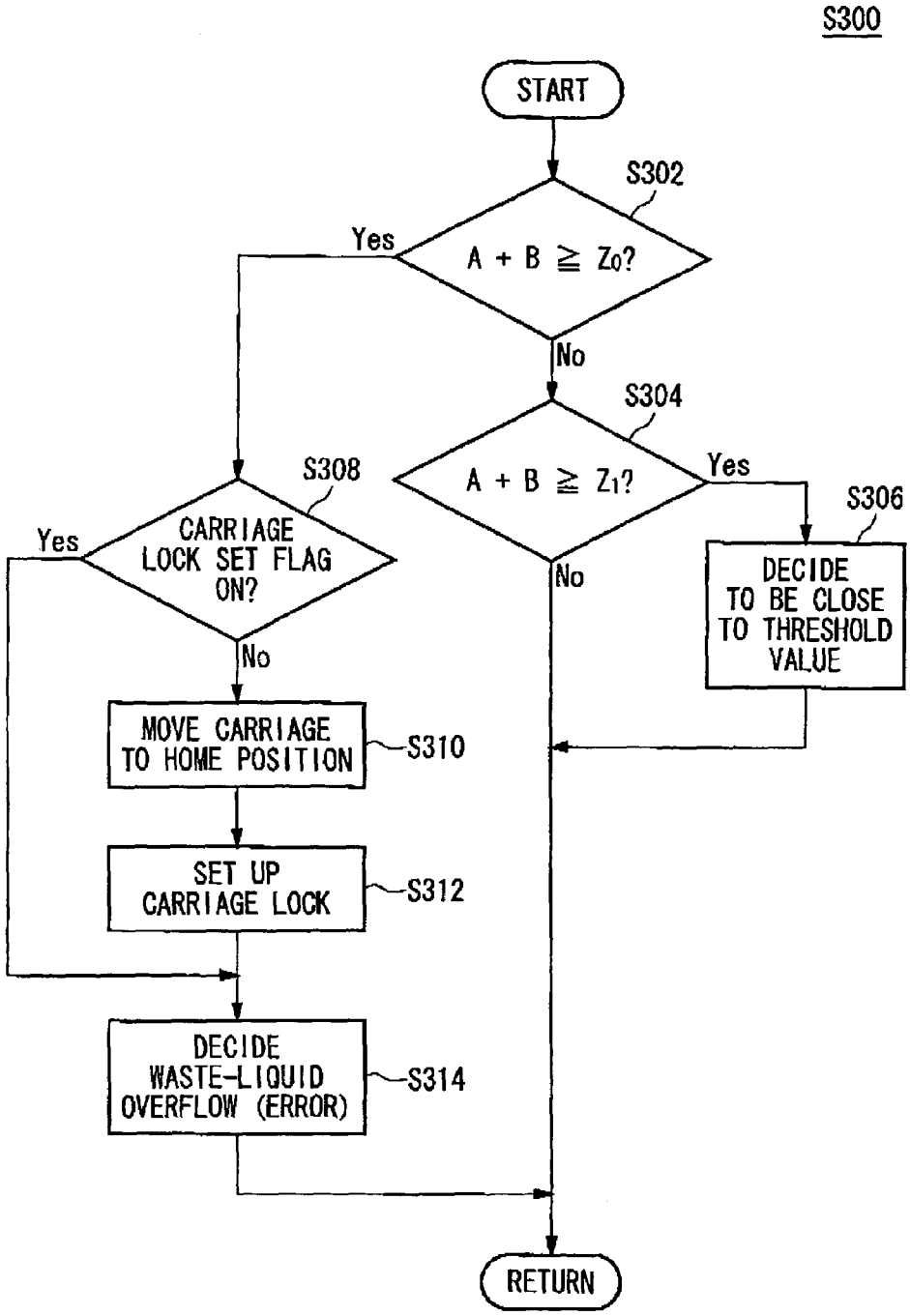
FIG. 5 is a flowchart showing further details about the step 300 in FIG. 3.
Figure 6:
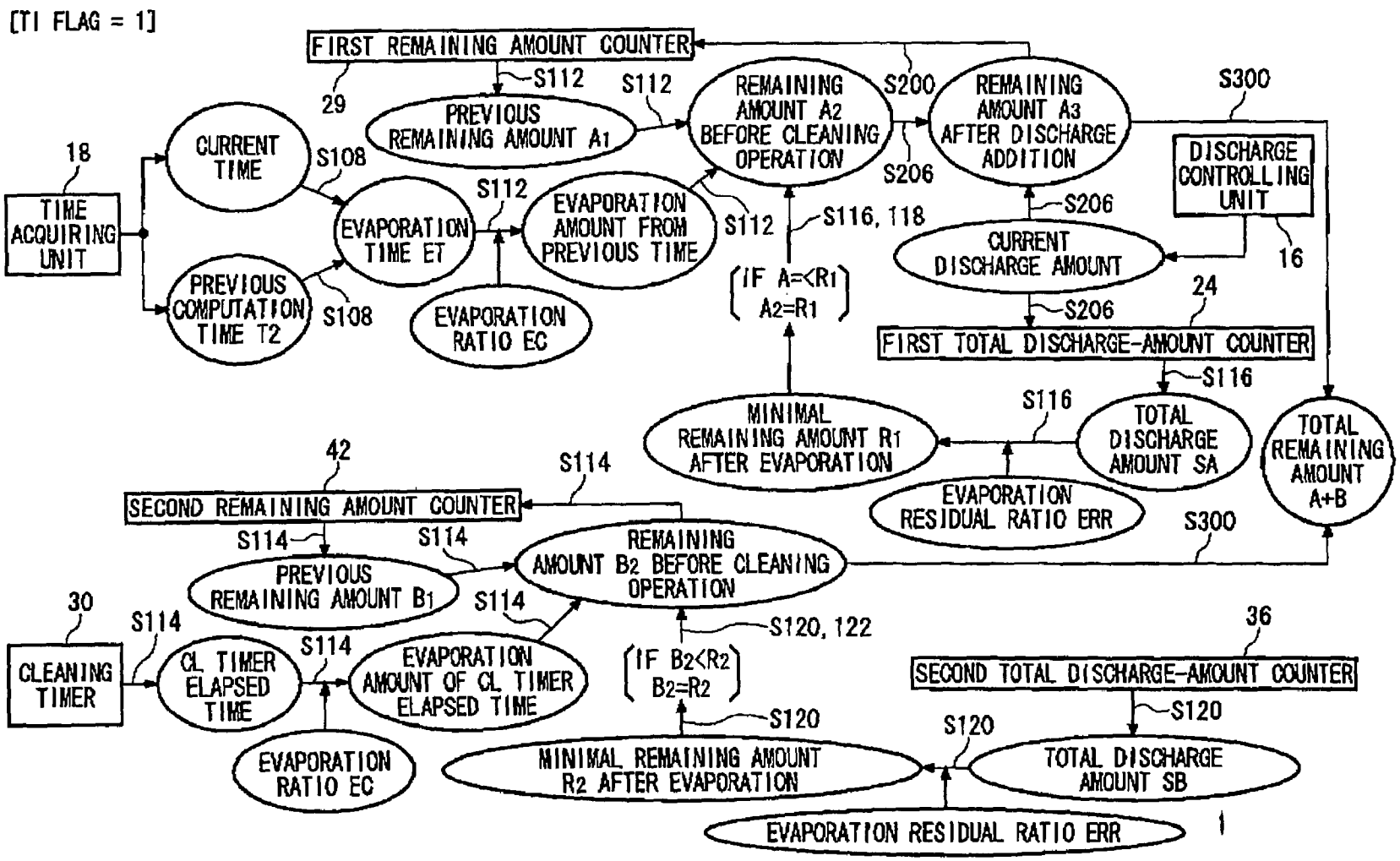
FIG. 6 is a data flowchart showing a change of parameters after the step 108 in FIG. 3.
Figure 7:
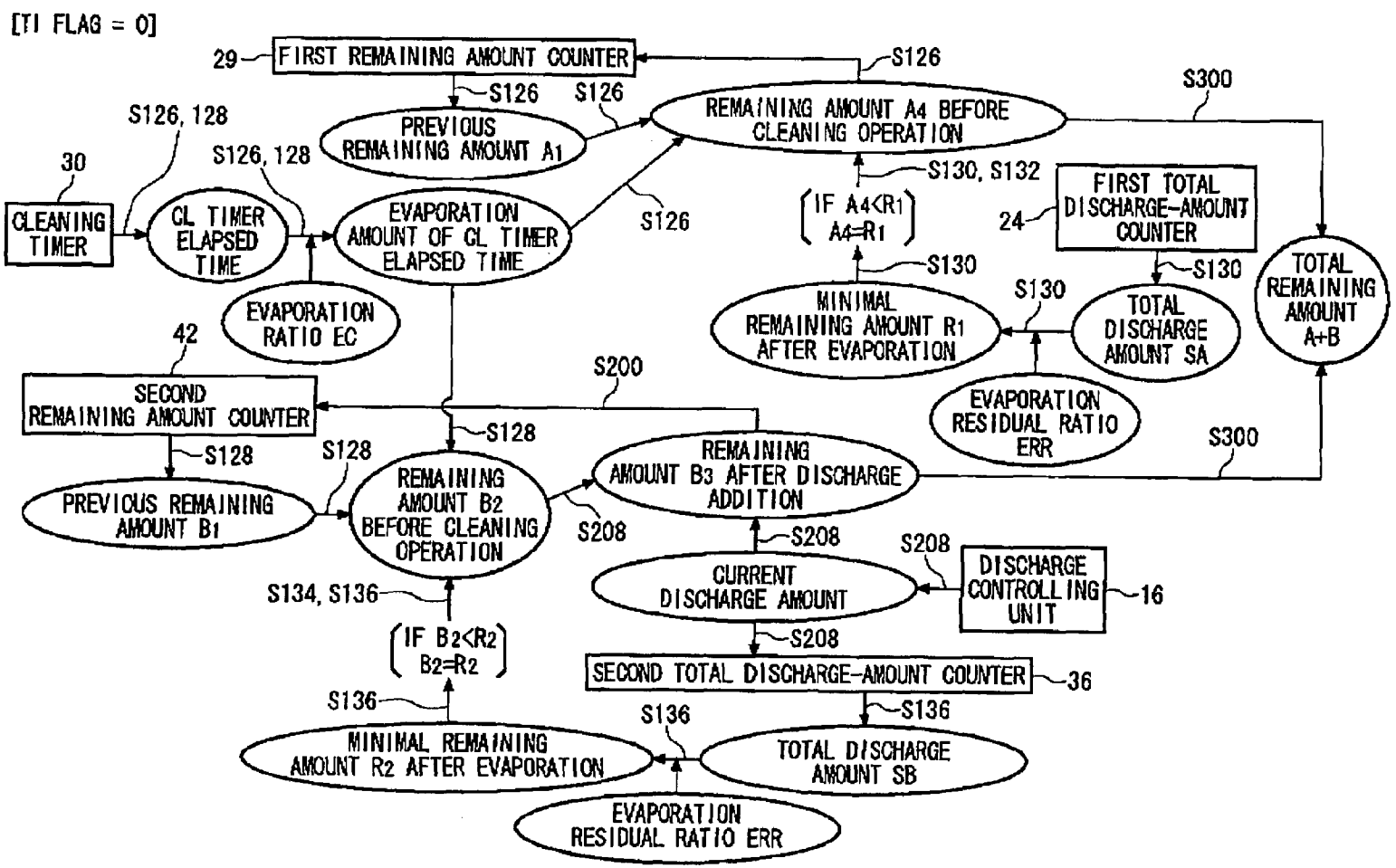
FIG. 7 is a data flowchart showing a change of parameters after the step 126 in FIG. 3.

FIGS. 3 to 5 are flowcharts showing the steps by which the ink-jet type recording apparatus 100 computes a remaining amount of waste liquid. FIGS. 6 and 7 are data flowcharts showing when the ink-jet type recording apparatus 100 operates in according to the flows of FIGS. 3 to 5. Moreover, FIGS. 6 and 7 correspond to a change of parameters after the step 108 and the step 126 in FIG. 3, respectively. The positions in FIGS. 6 and 7 corresponding to each step in FIGS. 3 to 5 have the step number identical with that in FIGS. 3 to 5.

It will be assumed that the latest time stored in the time acquiring unit 18 is T2, a remaining amount of waste liquid stored in the first remaining amount counter 29 is A, a remaining amount of waste liquid stored in the second remaining amount counter 42 is B, a total discharge amount stored in the first total discharge-amount counter 24 is SA, a total discharge amount stored in the second total discharge-amount counter 36 is SB, an evaporation coefficient is EC, an evaporation residual ratio is ERR, (T2-current time) is ET (evaporation timer), a threshold value of waste liquid that can be accommodated by the waste liquid absorber 12 is $Z_0$, a limit-access reference value lower than $Z_0$ is $Z_1$, and an elapsed time measured by the cleaning timer 30 is CL time.

The start-up of this flow is triggered by an initialization operation when the power source of the ink-jet type recording apparatus 100 is turned off and each cleaning operation. First, the time acquiring unit 18 decides whether the time T2 is indefinite (T2=0) or not (S100). Indefiniteness of the time T2 is means that the time acquiring unit 18 has never acquired time form the host. When acquiring time first after setting up the ink-jet type recording apparatus 100, the time acquiring unit 18 stores that time as T2.

When the time T2 is indefinite in the step S100, the ink-jet type recording apparatus 100 adds up a discharge amount of ink in the step S200. Meanwhile, when the time T2 is not indefinite, the total remaining amount computing unit 45 acquires A from the first remaining amount counter 29 and B from the second remaining amount counter 42, the overflow deciding unit 44 decides whether the total amount (A+B) is higher than the limit-access reference value $Z_0$ (S102). The $Z_1$ is lower value than the threshold value $Z_0$ of waste liquid that can be accommodated by the waste liquid absorber 12, representing that the $Z_0$ approaches. When deciding that the total amount (A+B) is higher than the $Z_1$, the ink-jet type recording apparatus 100 adds up a discharge amount of ink in the step S200. For example, the limit-access reference value $Z_1$ is set to $Z_1=Z_o*(35/36)$ to arrive at the $Z_1$ before one month of the passage of three years (36 months) provided that the total remaining amount of waste liquid arrives at the $Z_0$ in three years.

In this case, when deciding that the sum of the remaining amount of waste liquid exceeds the limit-access reference value $Z_1$ in the step S102, the discharge controlling unit 16 may decrease the discharge amount of ink in the subsequent cleaning operation. In this way, it is possible to reduce the increase speed of the remaining amount of waste liquid when the sum of the remaining amount of waste liquid approaches the threshold value of waste liquid that can be accommodated by the waste liquid absorber 12.

The time acquiring unit 18 sets TI flag depending on whether the time acquiring unit 18 has acquired time from the host after turning the ink-jet type recording apparatus 100 on or in the current cleaning operation. The TI flag is 1 when acquiring time from the host, the TI flag is 0 when not acquiring. The time acquiring unit 18 decides whether the TI flag is 1 (S104). When the TI flag is 1, the time acquiring unit 18 decides whether the acquired time satisfies a predetermined condition (S106).

The predetermined condition in the step S106 is a condition that decides whether difference between the time T2 and the currently acquired time is reasonable. For example, when the currently acquired time is earlier than the time T2, that is, the current time is earlier than the previous evaporation-computation time, it is considered that the time of the host has been changed. In addition, when upper bound of stop period of the ink-jet type recording apparatus 100 is T3, when the currently acquired time is higher than (T2+T3), the apparatus decides that the stop period exceeds the upper bound. When the time of the host is changed or the stop period exceeds the upper bound, the apparatus decides that a reliable evaporation time (ET) cannot be computed.

When the acquired time satisfies the above condition in the step S106, the ink-jet type recording apparatus 100 adds up a discharge amount of ink in the step S200. Meanwhile, when the acquired time does not satisfy the above condition, the time acquiring unit 18 computes difference between the acquired time and the time T2 as the evaporation time ET (S108). Next, the time acquiring unit 18 stores the currently acquired time as the time T2 (S110). The first remaining amount computing unit 22 computes the product (ET*EC) of the ET computed in the step S108 and the evaporation coefficient EC as an evaporation amount from the previous computation time. Further, the first remaining amount computing unit 22 computes the remaining amount A of waste liquid after the evaporation computation by subtracting (ET*EC) from the remaining amount A of waste liquid acquired from the first remaining amount counter 29 (S112).

Meanwhile, the second remaining amount computing unit 34 acquires the CL time from the cleaning timer 30, computing an evaporation amount (CL time*ET) corresponding to the elapsed time of the CL time. The second remaining amount computing unit 34 computes the remaining amount B of waste liquid, to which the evaporation computation corresponding to the elapsed time of the CL time is performed, by subtracting (CL time*ET) from the remaining amount B of waste liquid stored in the second remaining amount counter 42 (S114).

Additionally, the ET is an amount of ink that is evaporated per unit of time from the waste liquid absorber 12 under high temperature environment of envisioned range. For example, the evaporation residual ratio expected under 40° C., 80% RH environment is 0.1 to 0.15 [g/h]. While the waste liquid accommodated in the waste liquid absorber 12 is evaporating, humidity within a housing of the ink-jet type recording apparatus 100 is maintained virtually constant. Thus, the evaporation of waste liquid is performed according to the difference of humidity between the inside of the housing and the outside by an opening of the housing. It is possible to change the EC according to the change of humidity when the apparatus includes a humidity measuring means for measuring humidity around the waste liquid absorber 12. However, the present embodiment simplifies computation and control by keeping the EC regular under high temperature and high humidity (40° C., 80%) environments.

Next, the first remaining amount diagnosing unit 26 computes a first minimal remaining amount $R_1$ of the waste liquid in the waste liquid absorber 12 by multiplying (SA*ERR) the total discharge amount SA stored in the first total discharge-amount counter 24 by the evaporation residual ratio ERR, deciding whether the remaining amount A of waste liquid computed by the first remaining amount computing unit 22 is lower than the $R_1$ (S116). When the remaining amount A of waste liquid is lower than the $R_1$, the remaining amount A is replaced with the first minimal remaining amount $R_1$ (SA*ERR) (S118).

Similarly, the second remaining amount diagnosing unit 38 computes a second minimal remaining amount $R_2$ of the waste liquid in the waste liquid absorber 12 by multiplying (SB*ERR) the total discharge amount SB stored in the second total discharge-amount counter 36 by the evaporation residual ratio ERR, deciding whether the remaining amount B of waste liquid computed by the second remaining amount computing unit 34 is lower than the $R_2$ (S120). When the remaining amount B of waste liquid is lower than the $R_2$, the remaining amount B is replaced with the second minimal remaining amount $R_2$ (SB*ERR) (S122). Next, the discharge controlling unit 16 informs the first remaining amount computing unit 22 and the first total discharge-amount counter 24 of an amount of waste liquid that is discharged this time. Each of the first remaining amount computing unit 22 and the first total discharge-amount counter 24 adds the informed discharge amount to the remaining amount A of waste liquid and the total discharge-amount SA respectively. The first remaining amount computing unit 22 updates the value of the first remaining amount counter 29 with the remaining amount A of waste liquid added by the discharge amount (S200). The details of the step S200 will be described below.

Meanwhile, when the TI flag is not 1 in the step S104 (S104: No), the time acquiring unit 18 acquires the CL time from the cleaning timer 30 and adds it to the time T2 (S124). Next, the second remaining amount computing unit 34 acquires the CL time from the cleaning timer 30, computing an evaporation amount (CL time*EC) corresponding to the elapsed time of the CL time. The first remaining amount computing unit 22 acquires the remaining amount A of waste liquid from the first remaining amount counter 29, computing the remaining amount A of waste liquid, to which the evaporation computation corresponding to the elapsed time of the CL time is performed, by subtracting (CL time*EC) from the remaining amount A of waste liquid (S126). Next, the second remaining amount computing unit 34 acquires the remaining amount 13 of waste liquid from the second remaining amount counter 42, computing the remaining amount B of waste liquid, to which the evaporation computation corresponding to the elapsed time of the CL time is performed, by subtracting (CL time*EC) from the remaining amount B of waste liquid (S128).

Next, the first remaining amount diagnosing unit 26 decides whether the remaining amount A of waste liquid computed by the first remaining amount computing unit 22 is lower than the first minimal remaining amount $R_1$ (SA*ERR) of the waste liquid (S130). When the remaining amount A of waste liquid is lower than the $R_1$, the remaining amount A is replaced with the first minimal remaining amount $R_1$ (SA*ERR) (S132). Similarly, the second remaining amount diagnosing unit 38 decides whether the remaining amount B of waste liquid computed by the second remaining amount computing unit 34 is lower than the second minimal remaining amount $R_2$ (SB*ERR) of waste liquid in the waste liquid absorber 12 (S134). When the remaining amount B of waste liquid is lower than the $R_2$, the remaining amount B is replaced with the second minimal remaining amount $R_2$ (SB*ERR) (S136). Next, the discharge controlling unit 16 informs the second remaining amount computing unit 34 and the second total discharge-amount counter 36 of an amount of waste liquid that is discharged this time. Each of the second remaining amount computing unit 34 and the second total discharge-amount counter 36 adds the informed discharge amount to the remaining amount B of waste liquid and the total discharge-amount SB respectively. The second remaining amount computing unit 34 updates the value of the second remaining amount counter 42 with the remaining amount B of waste liquid added by the discharge amount (S200).

Next, the total remaining amount computing unit 45 computes the total remaining amount (A+B) of waste liquid after the current cleaning operation by acquiring the remaining amount A of waste liquid from the first remaining amount computing unit 22 and the remaining amount B of waste liquid from the second remaining amount counter 42 and adding them. The overflow deciding unit 44 decides whether the total remaining amount (A+B) exceeds the waste liquid accommodating threshold value $Z_0$ (S300). When the total remaining amount (A+B) exceeds the waste liquid accommodating threshold value $Z_0$ in the step S300, the overflow deciding unit 44 outputs error decision.

Next, the overflow deciding unit 44 decides the presence or absence of an error-decision output (S138), performing outputs according to the type of errors when the error decision has been outputted. For example, the overflow deciding unit 44 outputs messages to the host (S140), which represent maintenance error and also cause a user to take a maintenance center the ink-jet type recording apparatus 100. The overflow deciding unit 44 stops all functions of the ink-jet type recording apparatus 100. When the error decision has not been outputted in the step S138 (S138: No), the step S140 is skipped. Here, this flowchart is terminated.

FIG. 4 is a flowchart showing further details about the step 200 (the step of adding an amount of waste liquid) in FIG. 3. First, the ink-jet type recording apparatus 100 decides whether a trigger of the operation in which the remaining amount of waste liquid is currently computed is the initialization operation by turning off the ink-jet type recording apparatus 100 (S202). When the current trigger is the initialization operation by turning off the power source (S202: Yes), this flowchart is terminated.

Meanwhile, when the current trigger is not the initialization operation by turning off the power source (S202: No), the ink-jet type recording apparatus 100 decides whether the TI flag is 1, that is, the current time has been acquired from the host (S204). When the TI flag is 1, the discharge controlling unit 16 informs the first total discharge-amount counter 24 and the first remaining amount computing unit 22 of the amount of waste liquid that is discharged during the current cleaning operation. The first total discharge-amount counter 24 adds the informed discharge amount to the total amount SA of waste liquid that is discharged so far and memorizes the result. The first remaining amount computing unit 22 computes the remaining amount A of waste liquid after the current cleaning operation by adding the informed discharge amount to the remaining amount A of waste liquid outputted by the first remaining amount diagnosing unit 26 (S206).

Meanwhile, when the TI flag is not 1 in the step S204 (S204: No), the discharge controlling unit 16 informs the second total discharge-amount counter 36 and the second remaining amount computing unit 34 of the amount of waste liquid that is discharged during the current cleaning operation. The second total discharge-amount counter 36 adds the informed discharge amount to the total amount SB of waste liquid that is discharged so far and memorizes the result. The second remaining amount computing unit 34 computes the remaining amount B of waste liquid after the current cleaning operation by adding the informed discharge amount to the remaining amount B of waste liquid outputted by the second remaining amount diagnosing unit 38 (S208). Here, this flowchart is terminated.

FIG. 5 is a flowchart showing further details about the step 300 (the step of deciding overflow of waste liquid) in FIG. 3. First, the total remaining amount computing unit 45 acquires the remaining amount A of waste liquid from the first remaining amount counter 29 and the remaining amount B of waste liquid from the second remaining amount counter 42 and adds them. The overflow deciding unit 44 decides whether the added result (A+B) is more than the waste liquid accommodating threshold value $Z_0$ (S302). When the added result (A+B) is more than the Z (S302: Yes), the carriage controlling unit 15 decides whether a carriage-lock set flag is ON (S308). The carriage-lock set flag represents whether a carriage lock for fixing the position of the carriage to a home position is set.

When the carriage-lock set flag is not ON (S308; No), the carriage controlling unit 15 moves the carriage to the home position (S310), setting up the carriage lock (S312). The overflow deciding unit 44 outputs an error message that indicates that the waste liquid is close to the overflow (S314), this flowchart is terminated. Meanwhile, when the carriage-lock set flag is ON (S308; Yes), the overflow deciding unit 44 immediately proceeds to the step S314.

Meanwhile, when the added result (A+B) is not more than the waste liquid accommodating threshold value $Z_0$ (S302: No), the overflow deciding unit 44 decides whether the added result (A+B) is more than the limit-access reference value $Z_1$ (S304). When the added result (A+B) is more than the $Z_1$ (S304: Yes), the overflow deciding unit 44 outputs a decision message that indicates that the waste liquid is close to the waste liquid accommodating threshold value $Z_0$ (S306). Meanwhile, when the added result (A+B) is not more than the $Z_1$ (S304: No), this flowchart is terminated. Here, the step 300 of deciding overflow of waste liquid is terminated.

In this way, the ink-jet type recording apparatus 100 distinctively manages the remaining amount of waste liquid that is computed using the evaporation amount computed based on time information acquired from the host and the remaining amount of waste liquid that is computed using the evaporation amount in a state where there is not time information acquired from the host, adding them in the step of computing the total amount of waste liquid in the waste liquid absorber 12. Thus, it is possible to accurately compute the remaining amount of waste liquid. Therefore, it is possible to utilize a waste-liquid absorbing function of the waste liquid absorber 12 at a maximum and prevent the waste liquid from leaking outside the apparatus.

The above embodiment can be applied to an ink-jet type recording apparatus 100 capable of recording without communicating with a host such as an ink-jet type recording apparatus 100 with a scanner and an ink-jet type recording apparatus 100 capable of directly printing from a recording medium. It is not necessarily the case that such an ink-jet type recording apparatus 100 can acquire time from a host. Thus, such an ink-jet type recording apparatus 100 can accurately compute the remaining amount using the above embodiment compared with the case where the remaining amount of waste liquid is computed using only the time from the host or only the time from the built-in cleaning timer 30.

In addition, the above embodiment computes an amount of waste liquid, which is evaporated from the previous cleaning operation to the current cleaning operation, in proportion to time regardless of the discharge amount of individual cleaning operation up to the previous time. Alternatively, an amount of waste liquid that is evaporated up to the current cleaning operation may be computed based on the discharge amount of individual cleaning operation up to the previous time. For example, it is assumed that a discharge amount during the first cleaning operation is 2 g, an evaporation coefficient is 0.04 g/h, and a maximal evaporation ratio is 0.6. In this case, when the second cleaning operation is performed after ten hours from the first cleaning operation, the first remaining amount computing unit 22 (or the second remaining amount computing unit 34, hereinafter equal in this and next paragraphs) computes the evaporation amount as 0.4 g (=10 h*0.04 g/h). Further, it is assumed that the third cleaning operation is performed after 30 hours from the second cleaning operation, i.e., after 40 hours from the first cleaning operation. In this case, although the first remaining amount computing unit 22 computes a computational evaporation amount as 1.6 g, the apparatus replaces the evaporation amount with 1.2 g (=0.6*2 g) based on the maximal evaporation ratio. The computational evaporation amount is an amount of waste liquid that is evaporated from the first cleaning operation to the third cleaning operation, the waste liquid being discharged during the first cleaning operation. Moreover, the first remaining amount computing unit 22 may similarly compute an amount of waste liquid that is evaporated from the second cleaning operation to the third cleaning operation, the waste liquid being discharged during the second cleaning operation, adding two evaporation amount to compute the total evaporation amount.

In the above computation, the first remaining amount computing unit 22 may treat the remaining amount as a fixed value with respect to an amount of waste liquid that is discharged during the cleaning operation a predetermined times ago, e.g. five times ago. This is because the evaporation has stopped. Alternatively, the first remaining amount computing unit 22 may also treat the remaining amount as a fixed value with respect to an amount of waste liquid that is discharged during the cleaning operation a predetermined time ago, e.g., 50 hours ago. In these cases, the first remaining amount computing unit 22 may also compute the evaporation amount and the remaining amount based on the above embodiment with regard to the cleaning operation within a predetermined times or time, adding them to the fixed value to compute the first remaining amount. In this way, it is possible to easily compute the remaining amount.

Furthermore, in the embodiments shown in FIGS. 1 to 7, the time acquiring unit 18 acquires time from a host during a cleaning operation. Instead of this or along with this, the time acquiring unit 18 may acquire time from a host when turning on a power source. In this case, the time acquiring unit 18 may also compute the current time based on the time when the power source has been turned on and the time interval that is measured by the cleaning timer 30 after turning on the power source.

Figure 8:
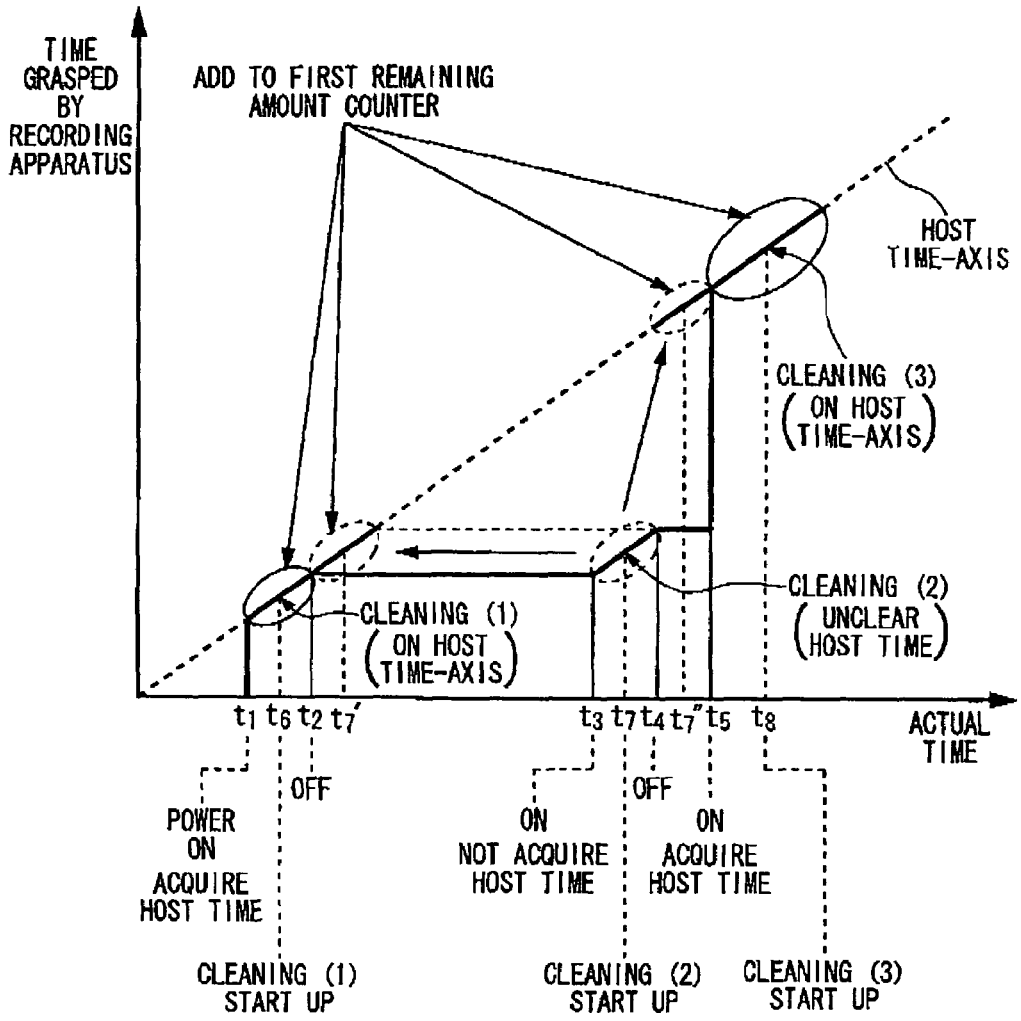
FIG. 8 is a chart showing another example of a method of computing a remaining amount of waste liquid.

FIG. 8 is a chart showing another example of a method of computing a remaining amount of waste liquid. In the embodiments shown in FIGS. 1 to 7, although the first remaining amount computing unit 22 and the second remaining amount computing unit 34 respectively compute the remaining amount when the time acquiring unit 18 acquires time from the host and the remaining amount when not acquiring time and the apparatus adds them, the computation method of the remaining amount is not limited this. In the embodiment shown in FIG. 8, when the time acquiring unit 18 does not acquire time, the first remaining amount computing unit 22 considers the time first measured or the time last measured by the cleaning timer 30 as the previously acquired time or the next acquired time respectively, computing the remaining amount. In this way, it is possible to approximately compute the evaporation amount until that time even when the time is unclear.

In the embodiment shown in FIG. 8, when the time acquiring unit 18 does not acquire time from the host, the first remaining amount computing unit 22 may compute the remaining amount as follows. When the time acquiring unit 18 does not acquire time from the host in the current cleaning operation, the first remaining amount computing unit 22 computes an evaporation amount based on the time interval from the previous cleaning operation time to the previously turned off time and the time interval measured by the cleaning timer 30 after turning on this time, computing the first remaining amount by subtracting the evaporation amount from the first remaining amount of waste liquid memorized in the first remaining amount counter 29. In the embodiment shown in FIG. 8, when not acquiring time in the current cleaning operation (2), the first remaining amount computing unit 22 computes an evaporation amount based on the time interval (t2–t6) from the previous cleaning operation (1) time to the turned off time and the time interval (t7–t3) measured by the cleaning timer 30 from the currently turned on time to the current cleaning operation (2) time. In other words, the apparatus considers the currently turned on time t3 as the previously turned off time t2, computing an evaporation amount (considering the current cleaning operation time t7 as t7').

Furthermore, when the time acquiring unit 18 does not acquire time from the host in the previous cleaning operation and the time acquiring unit 18 acquires time from the host in the current cleaning operation, the first remaining amount computing unit 22 computes the evaporation amount based on the time interval from the previous cleaning operation time to the previously turned off time and the time interval from the currently turned on time to the current cleaning operation time, and subtracts the evaporation amount from the first remaining amount of the waste liquid memorized in the first remaining amount counter 29 in order to compute the first remaining amount. In the embodiment shown in FIG. 8, when acquiring time in the current cleaning operation (3), the first remaining amount computing unit 22 computes an evaporation amount based on the time interval (the time is not yet determined) (t4–t7) from the previous cleaning operation (2) to the previously turned off time and the time interval (t8–t5) from the currently turned on time to the current cleaning operation (3) time. In other words, the apparatus considers the previously turned off time t4 as the currently turned on time t5, computing an evaporation amount (considering the previous cleaning operation time t7 as t7").

In addition, when the elapsed time from the previous cleaning operation exceeds a predetermined period, the ink-jet type recording apparatus 100 may cause the recovery section 14 to automatically perform the current cleaning operation. In this case, the recovery section 14 computes the elapsed time from the previous cleaning operation by acquiring time from the host via the time acquiring unit 18 and the discharge controlling unit 16. Here, when the recovery section 14 does not acquire time from the host during turning on, like the embodiment shown in FIG. 8, the apparatus considers an unclear time when turning on as the previously turned off time, adding the elapsed time measured by the cleaning timer 30 to the elapsed time from the previous cleaning operation. When the added elapsed time exceeds the predetermined period, the recovery section 14 performs a cleaning operation, clearing the elapsed time. In this way, it is possible to approximately acquire the elapsed time from the previous cleaning operation even when not acquiring time from the host and thus to automatically perform the cleaning operation at an appropriate time.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

What is claimed is:

1. A liquid ejecting apparatus for ejecting liquid to a target, comprising:

a liquid ejecting head operable to eject liquid;

a recovery section operable to recover liquid-ejection ability of said liquid ejecting head by performing a recovery operation during which said liquid ejecting head discharges the liquid to a position different from the target;

an accommodating section operable to accommodate waste liquid discharged from said liquid ejecting head during the recovery operation;

a discharge controlling unit operable to control an amount of waste liquid discharged from said liquid ejecting head during the recovery operation;

a time acquiring unit operable to acquire and memorize time from an external information processor;

a first remaining amount counter operable to memorize a first remaining amount of waste liquid in association with the recovery-operation time acquired from said time acquiring unit; and a first remaining amount computing unit operable to compute a first evaporation amount of waste liquid that has been evaporated after a recovery operation performed at least one time ago based on difference between current recovery-operation time and time of the recovery operation performed at least one time ago, to compute the first remaining amount of the waste liquid after the current recovery operation by subtracting the first evaporation amount from the first remaining amount of the waste liquid memorized in said first remaining amount counter and adding an amount of waste liquid, which is discharged to said accommodating section during the current recovery operation, to the subtracted result, and to write the computed first remaining amount into said first remaining amount counter in association with the current recovery-operation time, when said time acquiring unit acquires the current recovery-operation time from the information processor.

2. The liquid ejecting apparatus as claimed in claim 1, further comprising:

a timer operable to measure time passage in a state where a power source of the liquid ejecting apparatus is turned on;

a second remaining amount counter operable to memorize a second remaining amount of waste liquid when said time acquiring unit does not acquire time from the information processor; and a second remaining amount computing unit operable to compute a second evaporation amount of waste liquid that has been evaporated after recovery operation performed at least one time ago based on the time passage measured by said timer, to compute the second remaining amount of the waste liquid after the current recovery operation by subtracting the second evaporation amount from the second remaining amount of the waste liquid memorized in said second remaining amount counter and adding an amount of waste liquid, which is discharged to said accommodating section during the current recovery operation, to the subtracted result, and to write the computed second remaining amount into said second remaining amount counter, when said time acquiring unit does not acquire time from the information processor.

3. The liquid ejecting apparatus as claimed in claim 2, further comprising:

a total remaining amount computing unit operable to compute the sum of the first remaining amount and the second remaining amount; and an overflow deciding unit operable to output an error message when the sum of the first remaining amount and the second remaining amount computed by said total remaining amount computing unit exceeds a threshold value of waste liquid that can be accommodated by said accommodating section.

4. The liquid ejecting apparatus as claimed in claim 3, wherein said overflow deciding unit further causes said recovery section not to perform a recovery operation when the sum of the first remaining amount and the second remaining amount exceeds the threshold value of waste liquid that can be accommodated by said accommodating section.

5. The liquid ejecting apparatus as claimed in claim 2, further comprising:

a first total discharge-amount counter operable to memorize a first total amount of waste liquid discharged during the recovery operation when the current time is acquired;

a first remaining amount diagnosing unit operable to compute a first minimal remaining amount of the waste liquid that is accommodated in said accommodating section by multiplying the first total amount of waste liquid memorized in said first total discharge-amount counter by an evaporation residual ratio that is a ratio of liquid left by maximal evaporation of the liquid, and to replace the remaining amount of waste liquid computed by said first remaining amount computing unit with the first minimal remaining amount to write the replaced result into said first remaining amount counter when the remaining amount of waste liquid computed by said first remaining amount computing unit is lower than the first minimal remaining amount;

a second total discharge-amount counter operable to memorize a second total amount of waste liquid discharged during the recovery operation when the current time is not acquired; and a second remaining amount diagnosing unit operable to compute a second minimal remaining amount of the waste liquid that is accommodated in said accommodating section by multiplying the second total amount of waste liquid memorized in said second total discharge amount counter by the evaporation residual ratio, and to replace the remaining amount of waste liquid computed by said second remaining amount computing unit with the second minimal remaining amount to write the replaced result into said second remaining amount counter when the remaining amount of waste liquid computed by said second remaining amount computing unit is lower than the second minimal remaining amount.

6. The liquid ejecting apparatus as claimed in claim 1, wherein said first remaining amount computing unit treats the first evaporation amount of the waste liquid as zero when the time acquired by said time acquiring unit is earlier than the previously acquired time.

7. The liquid ejecting apparatus as claimed in claim 1, wherein said first remaining amount computing unit treats the evaporation amount of the waste liquid as zero when difference between the time acquired by said time acquiring unit and the current acquired time exceeds a predetermined reference value.

8. The liquid ejecting apparatus as claimed in claim 1, wherein said first remaining amount computing unit and said second remaining amount computing unit treat the evaporation amount of the waste liquid as zero when the sum of the first remaining amount and the second remaining amount exceeds a limit-access reference value lower than a threshold value of waste liquid that can be accommodated by said accommodating section.

9. The liquid ejecting apparatus as claimed in claim 1, wherein said discharge controlling unit reduces the amount of waste liquid discharged during the recovery operation when the sum of the first remaining amount and the second remaining amount exceeds a limit-access reference value lower than a threshold value of waste liquid that can be accommodated by said accommodating section.

10. The liquid ejecting apparatus as claimed in claim 1, further comprising a timer operable to measure time passage in a state where a power source of the liquid ejecting apparatus is turned on, wherein said first remaining amount computing unit computes the first evaporation amount based on time interval from the previous recovery-operation time to the previously turned off time and time interval that measured by said timer after turning on the power source this time, and subtracts the first evaporation amount from the first remaining amount of the waste liquid memorized in said first remaining amount counter in order to compute the first remaining amount, when said time acquiring unit does not acquire time from the information processor in the current recovery operation.

11. The liquid ejecting apparatus as claimed in claim 10, wherein said first remaining amount computing unit computes the first evaporation amount based on time interval from the previous recovery-operation time to the previously turned off time and time interval from the currently turned on time to the current recovery-operation time, and subtracts the first evaporation amount from the first remaining amount of the waste liquid memorized in said first remaining amount counter in order to compute the first remaining amount, when said time acquiring unit has not acquired time from the information processor in the previous recovery operation and said time acquiring unit acquires time from the information processor in the current recovery operation.

12. The liquid ejecting apparatus as claimed in claim 1, wherein said first remaining amount computing unit computes the first remaining amount using a predetermined fixed value as a remaining amount to a discharge amount with regard to the discharge amount of a recovery operation before a predetermined number of times or a predetermined time.

13. The liquid ejecting apparatus as claimed in claim 1, further comprising a timer operable to measure time passage in a state where a power source of the liquid ejecting apparatus is turned on, wherein said recovery section:

adds difference between the previous recovery-operation time and the current time to elapsed time after the previous recovery operation when said time acquiring unit has acquired the previous recovery-operation time and also acquires the current time from the information processor;

adds difference between the previous recovery-operation time acquired from the information processor and the previously turned off time and time interval from the currently turned on time to now, which is measured by said timer, to the elapsed time, when said time acquiring unit has acquired the previous recovery-operation time and does not acquire the current time; and performs the current recovery operation when the elapsed time after the previous recovery operation exceeds a predetermined period.

14. A liquid ejecting apparatus for ejecting liquid to a target, comprising:

a liquid ejecting head operable to eject liquid;

a recovery section operable to recover liquid-ejection ability of said liquid ejecting head by performing a recovery operation during which said liquid ejecting head discharges the liquid to a position different from the target;

an accommodating section operable to accommodate waste liquid discharged from said liquid ejecting head during the recovery operation;

a discharge controlling unit operable to control an amount of waste liquid discharged from said liquid ejecting head during the recovery operation;

a remaining amount counter operable to memorize a remaining amount of waste liquid;

a remaining amount computing unit operable to compute an evaporation amount of the waste liquid that has been evaporated from a recovery operation performed at least one time ago to a current recovery operation based on time passage between the current recovery operation and the recovery operation performed at least one time ago, to subtract the evaporation amount from the remaining amount of the waste liquid memorized in said remaining amount counter, and to add an amount of waste liquid, which is discharged to said accommodating section during the current recovery operation, to the subtracted result, in order to compute the remaining amount of the waste liquid after the current recovery operation and write the computed remaining amount into said remaining amount counter in association with the current recovery-operation time;

a total discharge-amount counter operable to memorize a total amount of waste liquid discharged during the recovery operation; and a remaining amount diagnosing unit operable to compute a minimal remaining amount of the waste liquid that is accommodated in said accommodating section by multiplying the total amount of waste liquid memorized in said total discharge-amount counter by an evaporation residual ratio that is a ratio of liquid left by maximal evaporation of the liquid, and to replace the remaining amount of waste liquid computed by said remaining amount computing unit with the minimal remaining amount to write the replaced result into said remaining amount counter when the remaining amount of waste liquid computed by said remaining amount computing unit is lower than the minimal remaining amount in the current recovery operation.

* * * * *